US007398710B1

(12) United States Patent
Ho

(10) Patent No.: US 7,398,710 B1
(45) Date of Patent: Jul. 15, 2008

(54) ROTARY POSITIONING STRUCTURE OF A RATCHET SCREWDRIVER

(76) Inventor: Shih-Chi Ho, 1F., No. 30, Jishan Rd., Dali City, Taichung County (TW)

( * ) Notice: Subject to any disclaimer, the term of this patent is extended or adjusted under 35 U.S.C. 154(b) by 0 days.

(21) Appl. No.: 11/617,611

(22) Filed: Dec. 28, 2006

(51) Int. Cl.
*B25B 13/46* (2006.01)

(52) U.S. Cl. ..... 81/63.1; 81/177.8; 192/43.2

(58) Field of Classification Search ..... 81/62, 81/63.1, 177.7–177.9; 192/43.2
See application file for complete search history.

(56) References Cited

U.S. PATENT DOCUMENTS 6,047,802 A * 4/2000 Huang ..... 192/43.2
6,435,061 B1 * 8/2002 Ho ..... 81/58.4
6,450,067 B1 * 9/2002 Liao ..... 81/62
7,174,810 B1 * 2/2007 Lin ..... 81/63.1
7,237,459 B1 * 7/2007 Shiao ..... 81/62
2002/0079181 A1 * 6/2002 Hsiao ..... 192/43.2
2004/0089109 A1 * 5/2004 Chen ..... 81/63.1
2004/0144217 A1 * 7/2004 Hu ..... 81/177.8
2004/0177731 A1 * 9/2004 Chen ..... 81/177.8
2007/0240544 A1 * 10/2007 Hu ..... 81/63.1

* cited by examiner

*Primary Examiner*—D. S Meislin
(74) *Attorney, Agent, or Firm*—Egbert Law Offices

(57) ABSTRACT

The present invention provides rotary positioning structure of the ratchet screwdriver. The rotary positioning structure includes two radial grooves, penetrating radially between the body of the ratchet screwdriver and the central axle hole. There are two ⊓-shaped snappers having a transverse rack and two vertical racks, and each is mounted separately into two radial grooves. The two vertical racks are inserted into two vertical slots. The transverse rack is placed opposite to the top flange of gear of the shaft lever. A flexible locker is used to press down the two ⊓-shaped snappers. A rotating drum is mounted and limited externally onto the body, while two troughs are arranged at intervals onto an inner wall of the retaining block opposite to the lower rivet holder, thereby forming a rotary positioning structure and offering a higher stability of positioning and ease-of-operation.

5 Claims, 10 Drawing Sheets

ROTARY POSITIONING STRUCTURE OF A RATCHET SCREWDRIVER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a ratchet screwdriver, and more particularly to a ratchet screwdriver with a rotary positioning structure.

2. Description of Related Art Including Information Disclosed Under 37 CFR 1.97 and 37 CFR 1.98

The ratchet screwdriver is exclusively designed such that the shaft lever could be positively driven (otherwise in an idle state), or reversely driven (otherwise in an idle state), or driven in both directions. The multiple drive modes are implemented through a rotary positioning structure for the ratchet screwdriver.

For the rotary positioning structure of a typical ratchet screwdriver, Taiwanese patent bulletin No. 500022 refers to "an improved structure of a ratchet screwdriver (one)" by the present inventor. FIG. 1 of the bulletin depicts the rotary positioning structure of the typical ratchet screwdriver. The shaft lever 10 for the screwdriver permits the body 11 to be screwed into central axle hole 13 through the pigeon hole 12. The leading edge of gear 14 of the shaft lever 10 is limited by inserting a spacing board 16 into an embedding groove 15 from the bottom of the body 11, such that the shaft lever 10 cannot slide. In addition, the body 11 is fitted with a tube shell 17, and a toggle button 18 is positioned between stop plates 19 and the preset mounting hole 21 of the tube shell 17, such that the toggle block 22 on top of toggle button 18 can be fixed into the mounting hole 21.

The following problem is observed from such typical structure during applications. The shaft lever 10 is fixed by two stop plates 19 and a spacing board 16. Yet, these two stop plates 19 are laterally placed at the gear 14 of the shaft lever 10, and the stop plates 19 are abutted with the gear 14 only through a flange of the plate. Thus, another spacing board 16 shall be designed, and an embedding groove 15 shall be placed at the bottom of the body 11 for insertion of the spacing board 16. But, the shaft lever 10 cannot be fixed stably. So, the positioning structure of shaft lever 10 for the typical ratchet screwdriver still lacks robustness.

Another problem is that the switching of a typical ratchet screwdriver is achieved through the slide of the toggle block 22 in order to control the swaying state of two stop plates 19. However, the switching distance of three modes (positive, reverse and bi-directional) is extremely short (approx. 5 mm) due to the short motion of brake disc 23 of toggle block 22 on the stop plate 19. In such case, it often leads to stronger application of force and excessive toggling, so the user has to adjust its force to achieve the switching.

Thus, to overcome the aforementioned problems of the prior art, it would be an advancement in the art to provide an improved structure that can significantly improve efficacy.

To this end, the inventor has provided the present invention of practicability after deliberate design and evaluation based on years of experience in the production, development and design of related products.

BRIEF SUMMARY OF THE INVENTION

The enhanced efficacy of the present invention is the innovation of two ⊓-shaped snappers 70 of the present invention that two vertical racks 72 of ⊓-shaped snappers 70 penetrate through two radial grooves 50. These two vertical racks 72 are placed securely at front and rear edges of the gear 41 of shaft lever 40, thereby offering higher robustness and durability of shaft lever 40.

In addition, the rotating drum 90 is rotated in collaboration with the retaining block 61 of the lower rivet holder 60 and troughs 91, 92 of the rotating drum 90 as well as the rotating drum positioning member 100. The drive mode of the shaft lever 40 can be controlled. Thus, it makes it possible for more accurate manual control, offering greater ease-of-operation and user-friendliness.

It is also worthy to note that, a ring flange 34 is provided at a front end of the body 30 for fixation of the rotating drum 90. So, the spacer 93 may be designed with a C-shaped snap ring, which is locked into a ring groove 35 at rear end of the body 30 for fixation of the rotating drum 90. As such, unlike a typical ratchet screwdriver, the present invention enables a unique assembly that the rotating drum 90 is screwed into the rear end of the body 30 when the body 30 is not yet mated with the handle of the ratchet screwdriver. Then, one end of rotating drum 90 is first positioned by stopping the ring flange 34 onto the rear end of the rotating drum 90, and the other end is fixed through screwing of the spacer 93.

With the adjusting and positioning member, B1 and B2 of the flexible joint B, being folded, the relative angle of the shaft lever 40 of ratchet screwdriver A versus the handle 301 can be adjusted (e.g. 180°, 90°) to meet the diversified requirements of the users.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
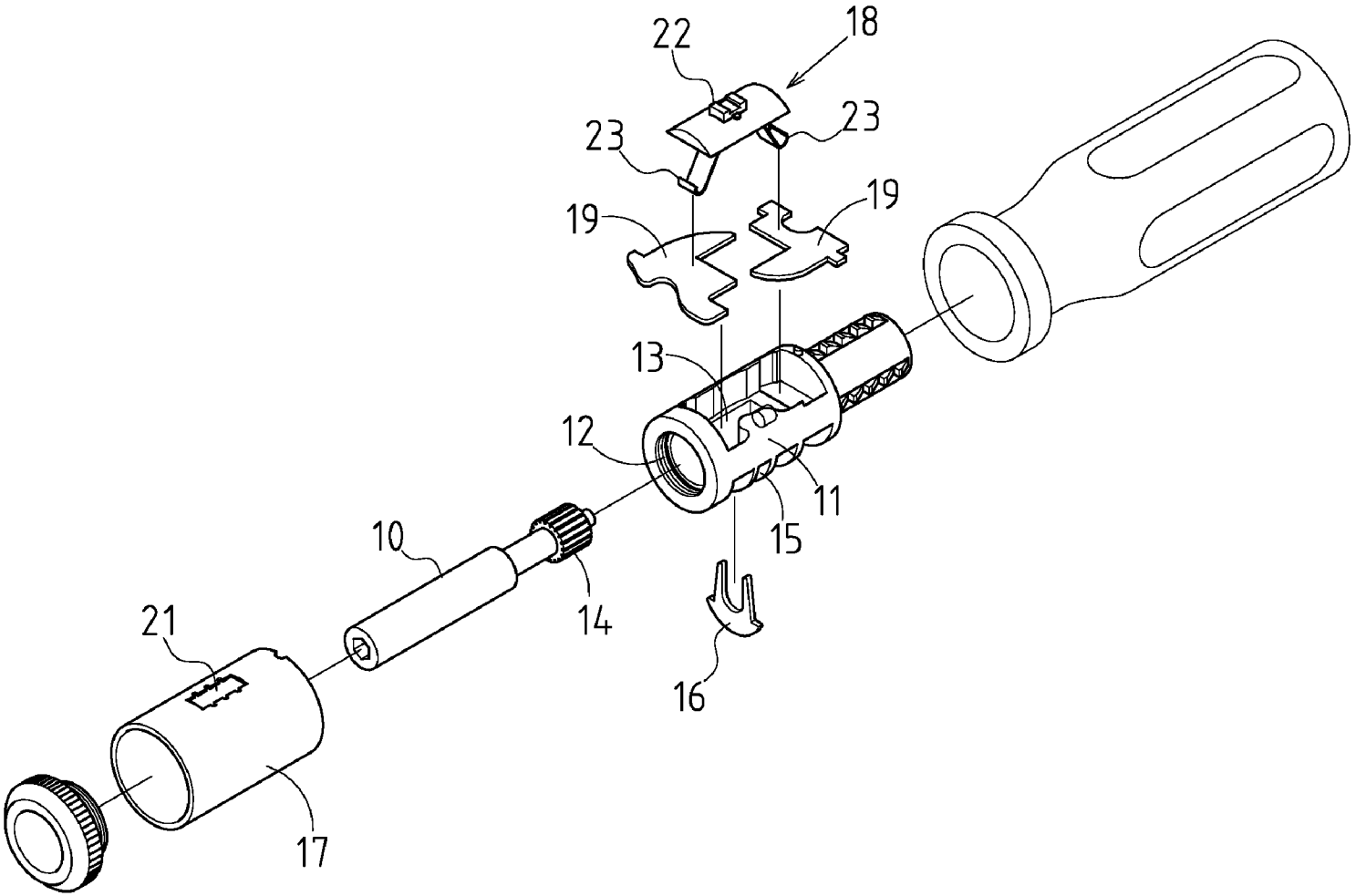
FIG.1 PRIOR ART
FIG. 1 shows an exploded perspective view of the typical structure of the prior art.
Figure 2:
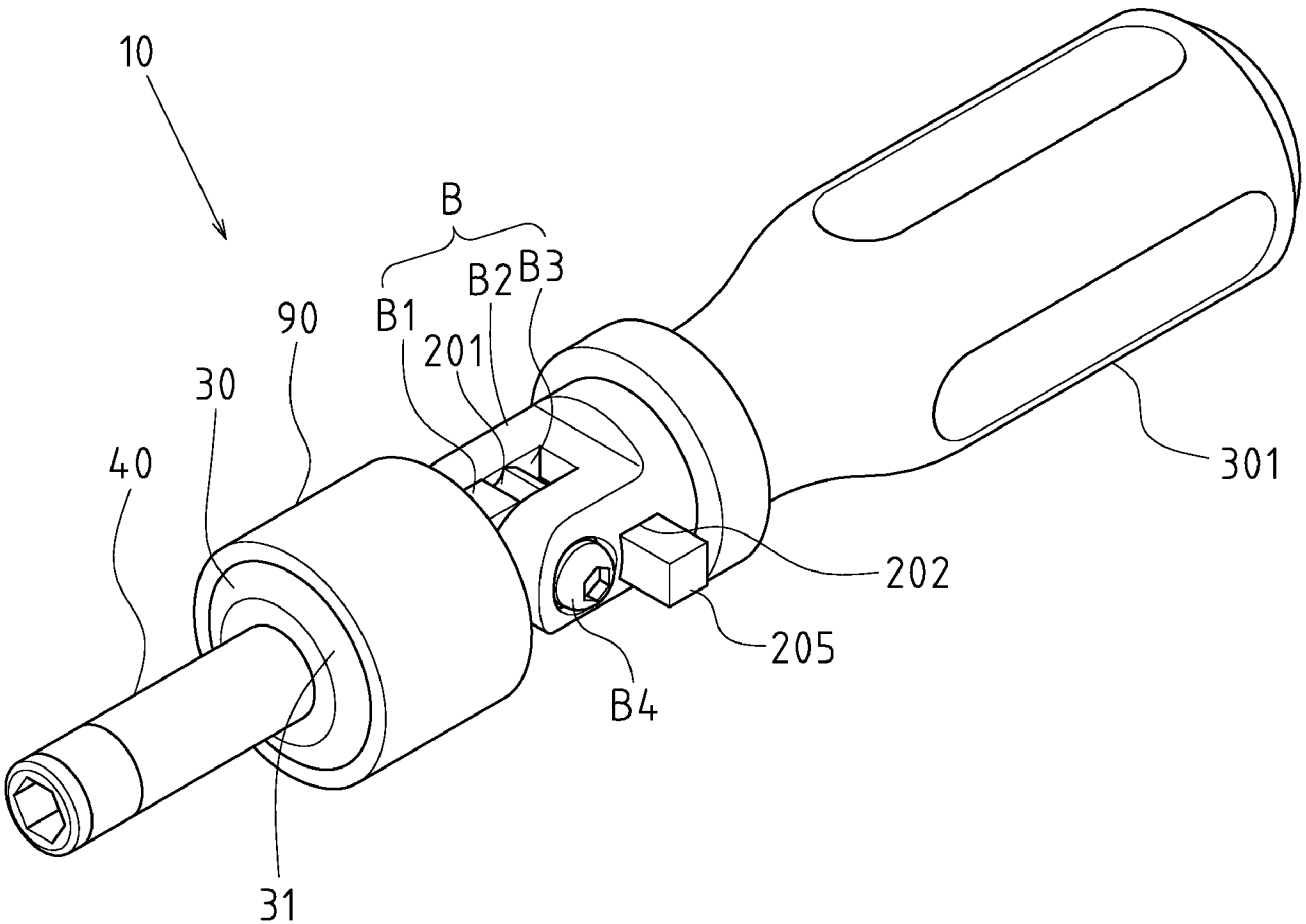
FIG. 2 shows an assembled perspective view of the preferred embodiment of the present invention.
Figure 3:
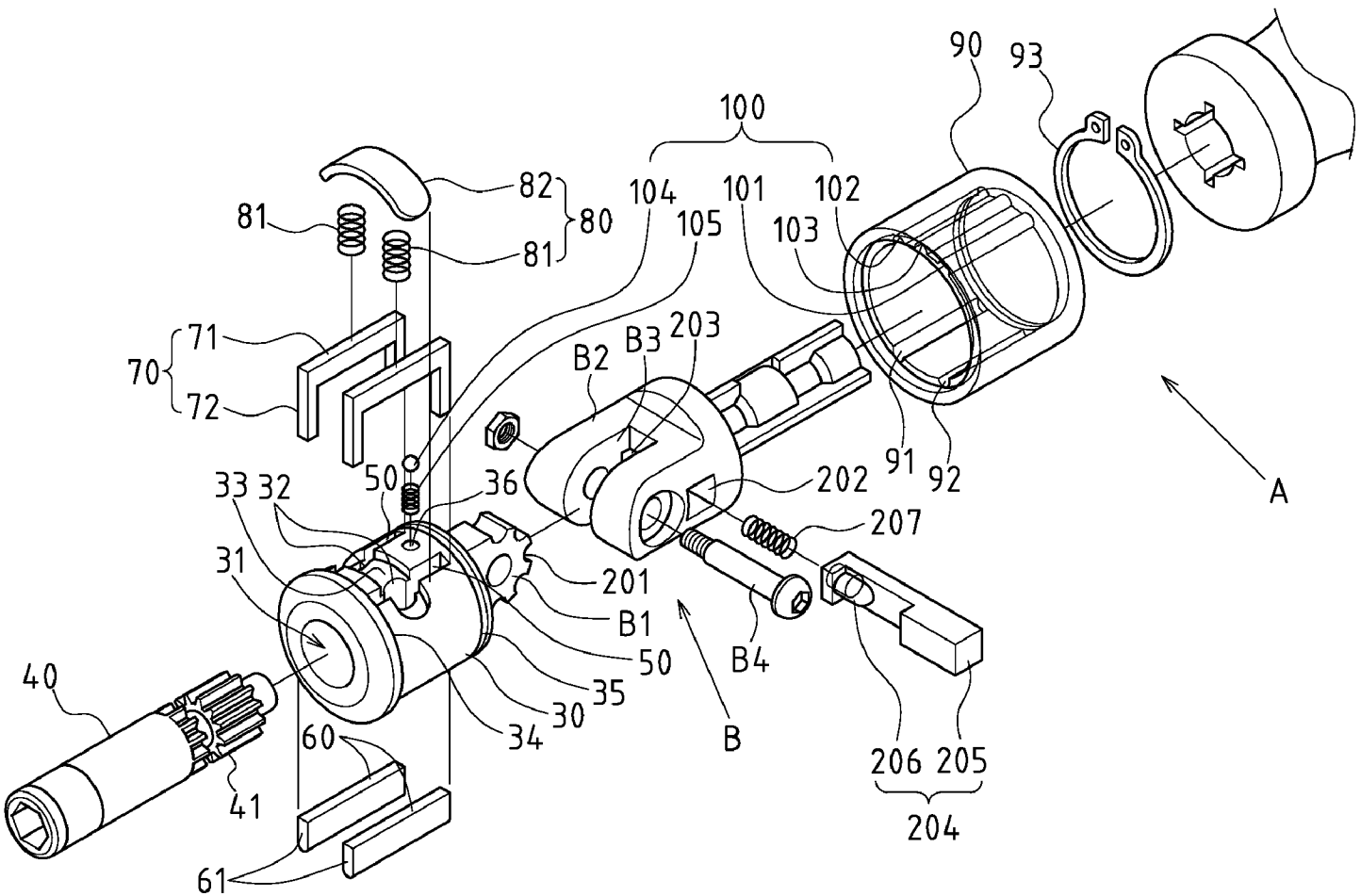
FIG. 3 shows an exploded perspective view of the preferred embodiment of the present invention.
Figure 4:
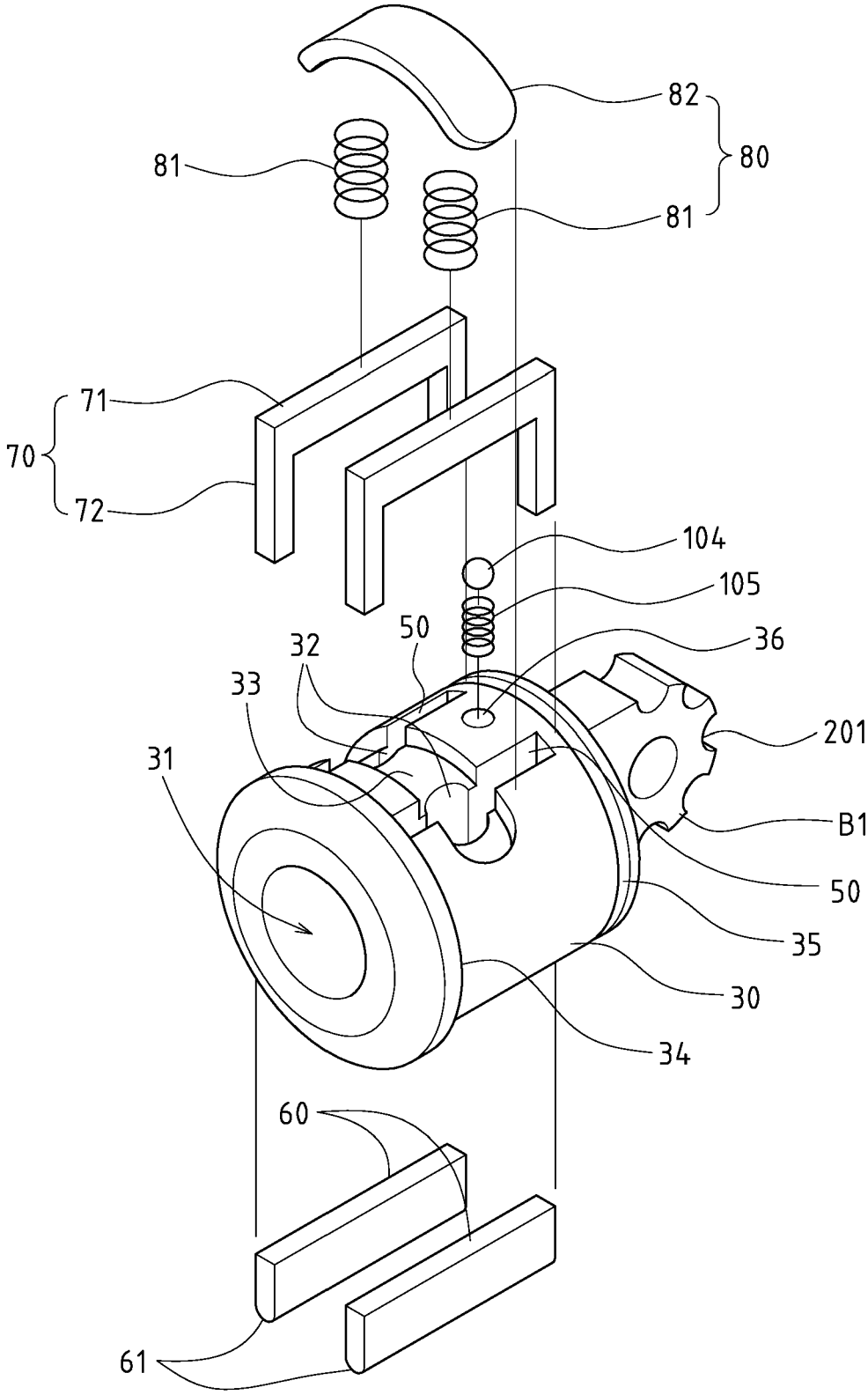
FIG. 4 shows a first enlarged perspective view of local components of FIG. 3.

The features and the advantages of the present invention will be more readily understood upon a thoughtful deliberation of the following detailed description of a preferred embodiment of the present invention with reference to the accompanying drawings.

FIGS. 2, 3, 4, 5 and 6 depict preferred embodiments of an improved rotary positioning structure of a ratchet screwdriver of the present invention, which, however, are provided only for explanatory purposes. The rotary positioning structure is mounted onto the body 30 of the ratchet screwdriver A to control the positive, reverse or bi-directional drive as well as positioning state of shaft lever 40. The body 30 has a central axle hole 31 for insertion of gear 41 of the shaft lever 40. A flexible joint B is provided between the body 30 and handle 301 of the ratchet screwdriver A, of which the first end B1 of the flexible joint B is a single convex member, and the other end B2 of the flexible joint B is provided with a rectangular groove B3 for insertion of the first end B1. A stud shaft B4 is placed between B1 and B2 for interlocking The rotary positioning structure comprises two radial grooves 50, which are penetrating radially between the body 30 and central axle hole 31. These two radial grooves 50 are arranged in parallel, while an upper transverse slot 51, two vertical slots 52 and a lower transverse slot 53 are formed at the cross portion of the said radial groove 50. Two vertical slots 52 penetrate radially the central axle hole 31 oppositely to the front and rear edges of the gear 41 of shaft lever 40.

Two lower rivet holders 60 are placed separately within the lower transverse slot 53 of two radial grooves 50 for sliding flexibly. A retaining block 61 is placed at the bottom of two lower rivet holders 60 such that it could protrude from the body 30 to a preset height when the lower rivet holder 60 slides downwards to a preset stop position.

Two ⊓-shaped snappers 70 are comprised of a transverse rack 71 and two vertical racks 72. The ⊓-shaped snapper 70 is mounted separately into two radial grooves 50, and two vertical racks 72 of the ⊓-shaped snapper 70 can be inserted into two vertical slots 52 of two radial grooves 50. The bottom of two vertical racks 72 stops at the top of lower rivet holder 60. The transverse rack 71 of two ⊓-shaped snappers 70 is placed oppositely to the top flange of gear 41 of the shaft lever 40.

A flexible locker 80 is mounted onto upper part of two ⊓-shaped snappers 70 of the body 30, thereby pressing flexibly the ⊓-shaped snapper 70. The flexible locker 80 of the preferred embodiment comprises two springs 81 and a cover 82. Two chambers 32 are arranged at a top flange of the body 30 opposite to two radial grooves 50 for limiting of two springs. A recessed portion 33 is placed at a top of the body for insertion of cover 82.

A rotating drum 90 is mounted externally at the body 30 and is limited by a spacer 93. Two troughs 91, 92 are arranged at intervals onto an inner wall of the rotating drum 90 opposite to the lower rivet holder 60, making it possible to insert the retaining block 61 of lower rivet holder 60.

A rotating drum positioning member 100 is mounted onto the rotating drum 90 opposite to the body 30, serving the purpose of positioning when the rotating drum 90 rotates to a preset angle.

The retaining block 61 of the lower rivet holder 60 is designed with a projecting semicircular cross-portion, such that two troughs 91, 92 on an inner wall of rotating drum 90 are fabricated into a curved semicircular portion.

A ring flange 34 is provided at a front end of the body 30 for fixation of the rotating drum 90. The spacer 93 may be designed with a C-shaped snap ring, which is locked into a ring groove 35 at a rear end of the body 30 for fixation of the rotating drum 90.

The rotating drum positioning member 100 comprises a flexible bead 104, a positive positioning edge 101, a reverse positioning edge 102 and a bi-directional positioning edge 103. The flexible bead 104 can be mounted into a chamber 36 at top of the body 30, and a spring 105 is used to push it normally towards the inner wall of rotating drum 90. The positive positioning edge 101, reverse positioning edge 102 and bi-directional positioning edge 103 are arranged at intervals at an inner wall of rotating drum 90 opposite to the flexible bead 104. Thus, when the rotating drum 90 is rotated to different angles, it is locked separately by the flexible bead 104 onto the said positive positioning edge 101, or reverse positioning edge 102, or bi-directional positioning edge 103 for desirable positioning effect.

The adjusting and positioning member comprises a ratchet 201, which is mounted onto first end B1 of the flexible joint B.

There is also a spacing groove 202, which is mounted onto the other end B2 of the flexible joint B, of which a through-hole 203 is laterally placed on the spacing groove 202 oppositely to the ratchet 201.

A damper 204 is mounted into the spacing groove 202. The damper 204 comprises a push portion 205 and a snap edge 206, of which the push portion 205 protrudes from the spacing groove 202 to a preset height. The snap edge 206 is placed opposite to the through-hole 203 of spacing groove 202, so it can be released from or mated with the ratchet 201 when the damper 204 is in a recessed or protruding state.

A flexible resetter 207 is designed into a spring mounted within the spacing groove 202 for pushing out flexibly the damper 204.

Based upon above-specified structural design for the "rotary positioning structure of a ratchet screwdriver" of the present invention, the gear 41 of the shaft lever 40 could be mounted into the central axle hole 31 of the body 30.

Two ⊓-shaped snappers 70 are mounted into radial groove 50 of the body 30. The two vertical racks 72 are inserted into two vertical slots 52 of two radial grooves 50. And, the transverse rack 71 of two ⊓-shaped snappers 70 is placed opposite to the top flange of gear 41 of the shaft lever 40.

Two lower rivet holders 60 are separately placed into lower transverse slot 53 of two radial grooves 50, such that the bottom of two vertical racks 72 of two ⊓-shaped snappers 70 stops at the top flange of two lower rivet holder 60.

The spring 81 and cover 82 of the flexible locker 80 is separately placed into the radial groove 50 and recessed portion at top of the body 30. The flexible bead 104 and spring 105 of the rotating drum positioning member 100 is mounted into the chamber 36 on top of the body 30.

The rotating drum 90 is mounted externally at the body 30, such that the spring 81 and cover 82 of the said flexible locker 80 as well as the flexible bead 104 and spring 105 of the rotating drum positioning member 100 could be limited. Then a spacer 93 (a C-shaped snap ring in the preferred embodiment) is locked into the ring groove 35 at rear end of the body 30 for fixation of the rotating drum 90. So, the entire rotary positioning structure of the ratchet screwdriver is assembled.

Figure 5:
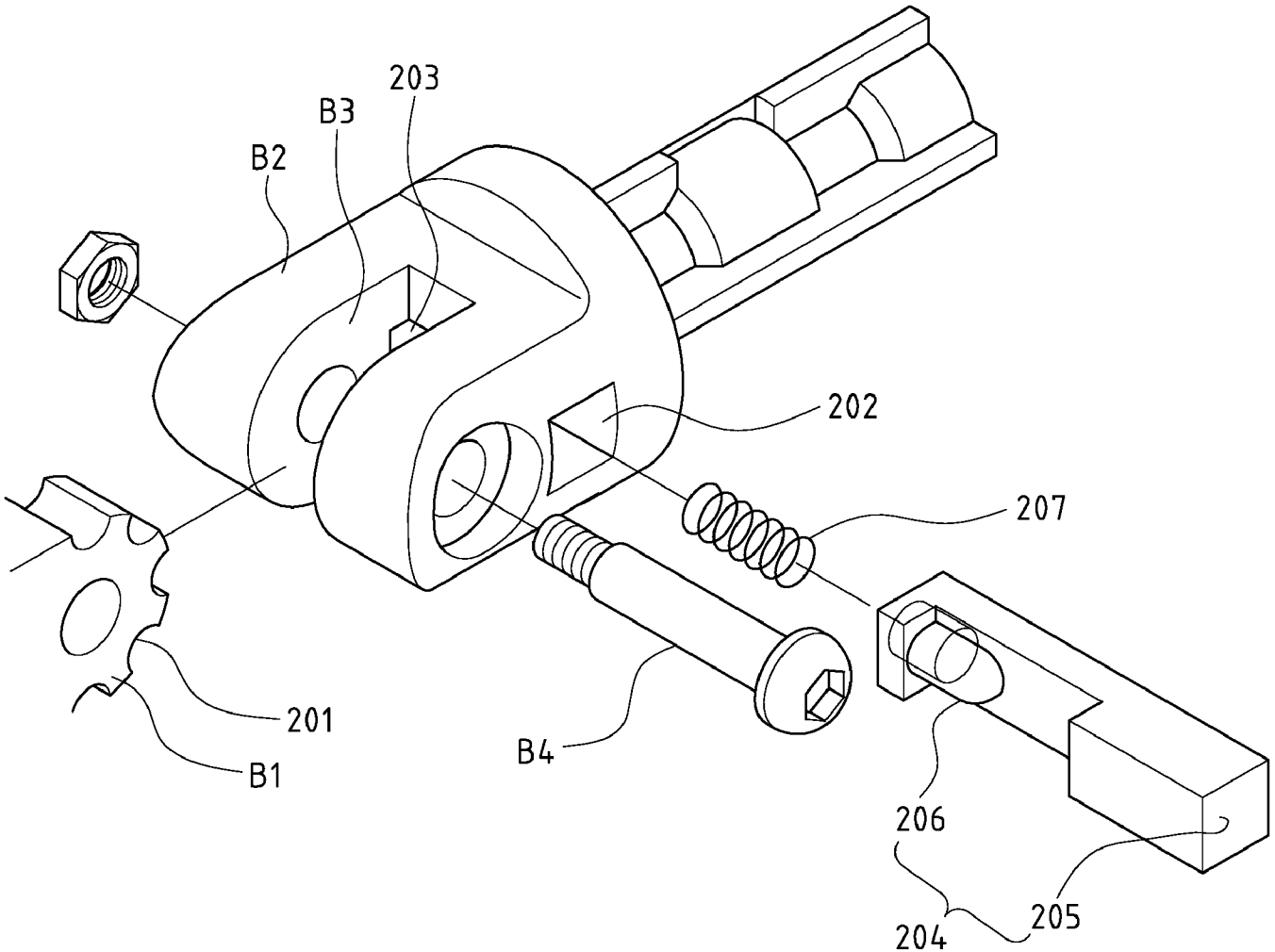
FIG. 5 shows a second enlarged perspective view of local components of FIG. 3.
Figure 6:
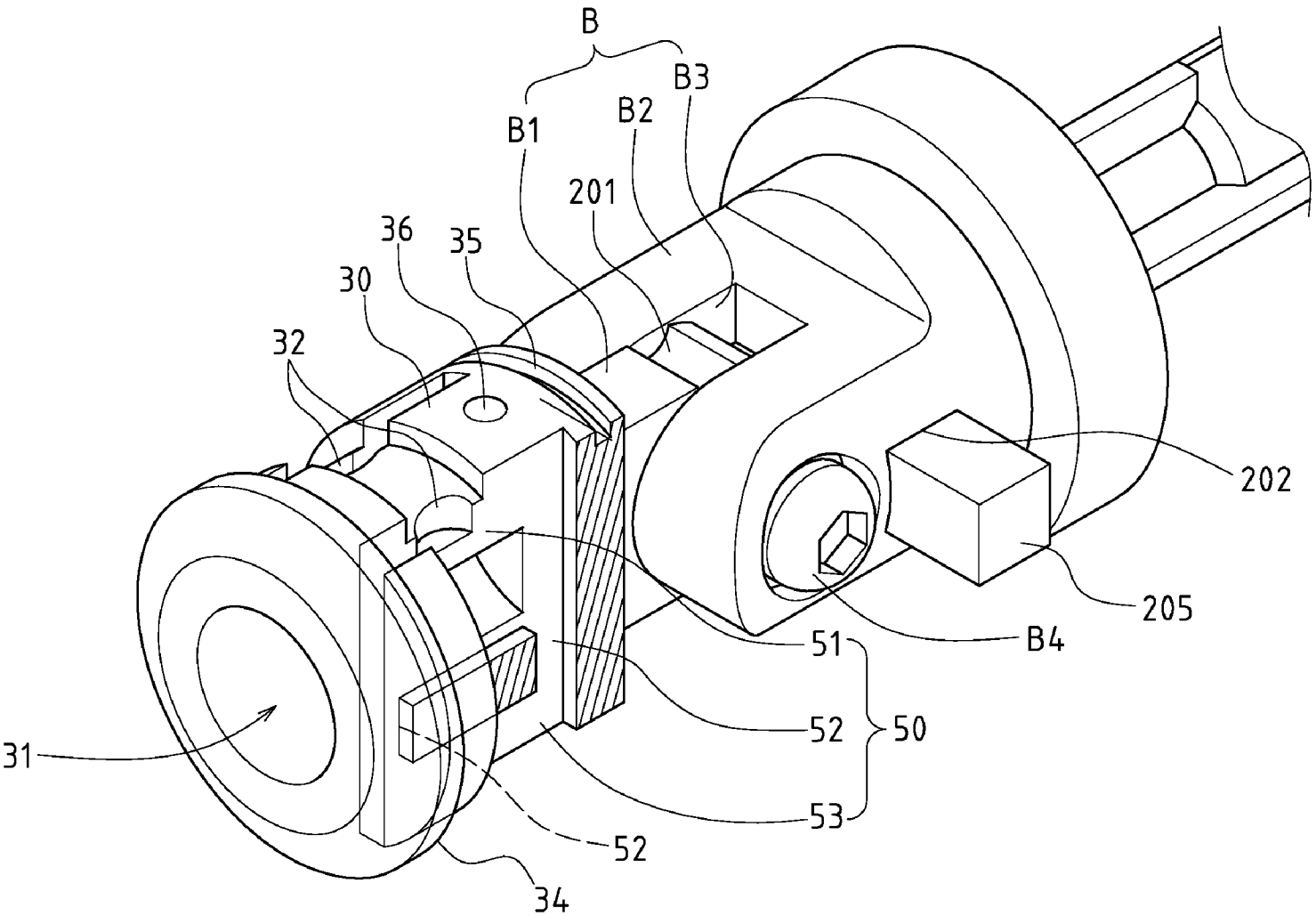
FIG. 6 shows another isolated perspective view of the preferred embodiment of the present invention.

The switching behavior of the present invention is performed as follows:

Referring to FIGS. 5 and 6, when the rotating drum 90 is placed in a position where the flexible bead 104 is locked onto the bi-directional positioning edge 103, the retaining blocks 61 of two lower rivet holders 60 are separately snapped into two troughs 91, 92 at an inner wall of rotating drum 90. In such a case, the vertical rack 72 and transverse rack 71 of two ⊓-shaped snappers move downwards, so the transverse rack 71 is stopped laterally at the top of gear 41 of the shaft lever 40, making it possible for bi-directional drive without slippage between the shaft lever 40 and the body 30.

Figure 7:
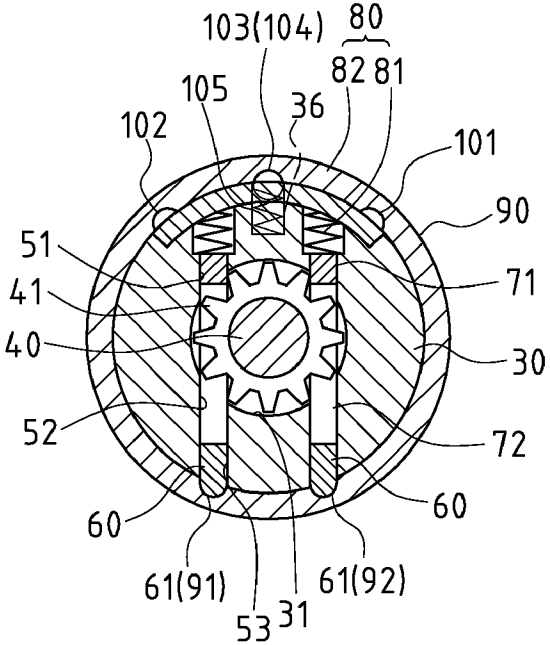
FIG. 7 shows a radial sectional view of local structure of the preferred embodiment of the present invention.
Figure 10:
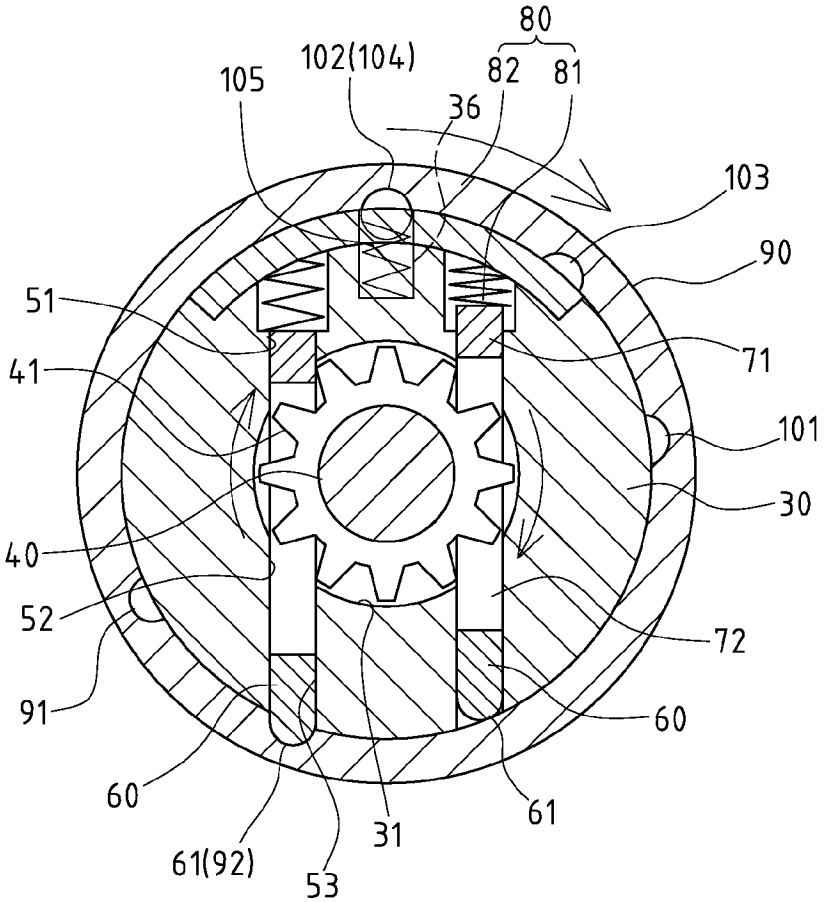
FIG. 10 shows a cross-sectional view of another operating behavior of the present invention.
Figure 9:
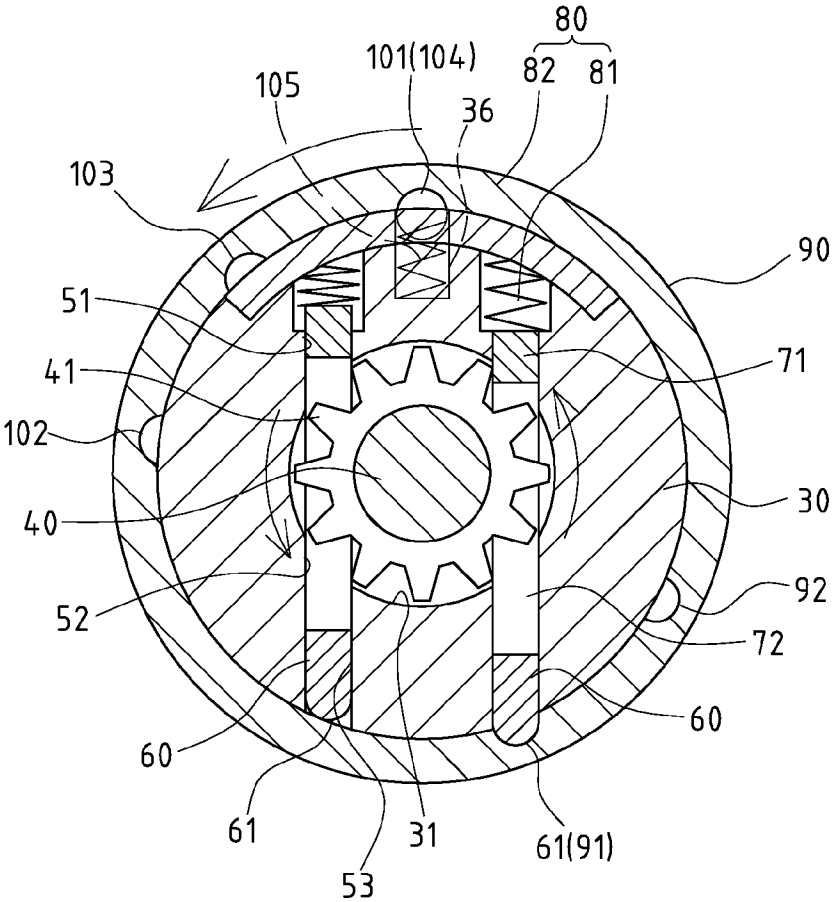
FIG. 9 shows a cross-sectional view of one operating behavior of the present invention.

Referring also to FIG. 7, when the rotating drum 90 is rotated in such a manner that the flexible bead 104 is locked into the positive positioning edge 101, the retaining block 61 of the lower rivet holder 60 at a right side of the figure will be locked into a trough 91 of the rotating drum 90. The retaining block 61 of lower rivet holder 60 at left side of the figure is pushed by the rotating drum 90 since it is not locked to the trough. In such a case, the vertical rack 72 of the ⊓-shaped snapper at a right side of the figure will move downwards along with the lower rivet holder 60, such that the transverse rack 71 of the ⊓-shaped snapper shifts downwards to be locked into right-hand of the top of gear 41 of the shaft lever 40. The vertical rack 72 of ⊓-shaped snapper at a left side of the figure will move upwards along with the lower rivet holder 60, such that the transverse rack 71 of left-hand-shaped snapper shifts upwards to be separated from the left-hand of the top of gear 41 of the shaft lever 40. In the case of reserve rotation, the gear 41 of the shaft lever 40 can span over the transverse rack 71, the ⊓-shaped snapper, or in the case of positive rotation, can be stopped by the transverse rack 71 of the right-hand ⊓-shaped snapper, forming a positive drive mode as mentioned above.

Figure 8:
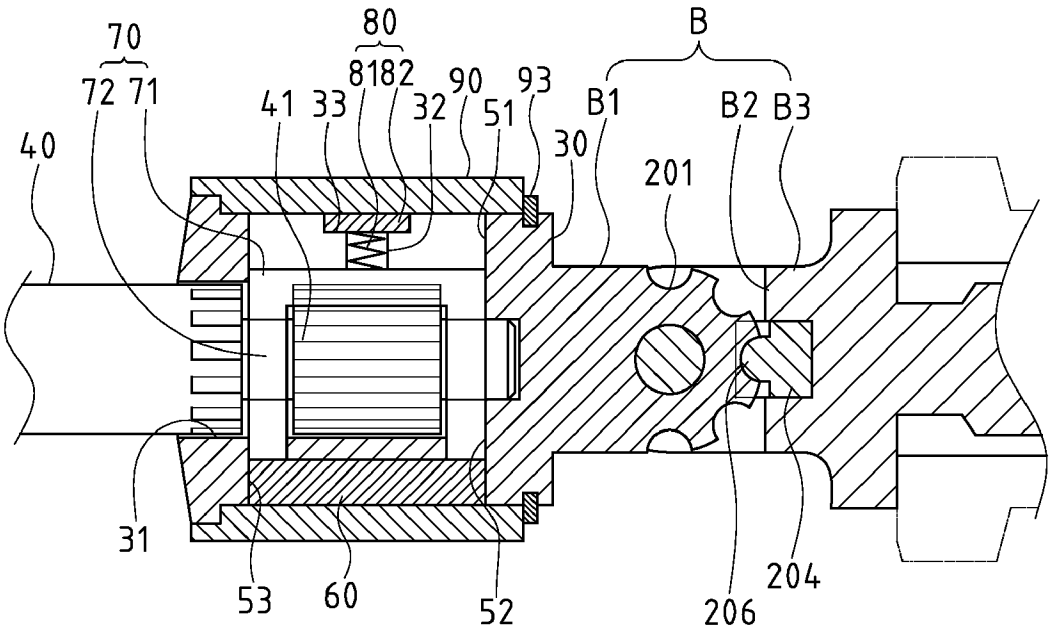
FIG. 8 shows an axial sectional view of local structure of the preferred embodiment of the present invention.

Referring also to FIG. 8, when the rotating drum 90 is rotated in such a manner that the flexible bead 104 is locked into the reverse positioning edge 102, the retaining block 61 of the lower rivet holder 60 at left side of the figure will be locked into a trough 92 of the rotating drum 90. The retaining block 61 of lower rivet holder 60 at a right side of the figure is pushed by the rotating drum 90 since it is not locked with the trough. In such a case, the vertical rack 72 of the ⊓-shaped snapper at a left side of the figure will move downwards along with the lower rivet holder 60, such that the transverse rack 71 of -shaped snapper shifts downwards to be locked into left-hand of the top of gear 41 of the shaft lever 40. The vertical rack 72 of ⊓-shaped snapper at a right side of the figure will move upwards along with the lower rivet holder 60, such that the transverse rack 71 of right-hand ⊓-shaped snapper shifts upwards to be separated from the right-hand of the top of gear 41 of the shaft lever 40. In the case of positive rotation, the gear 41 of the shaft lever 40 can span over the transverse rack 71, the ⊓-shaped snapper, or in the case of reverse rotation, can be stopped by the transverse rack 71 of the right-hand, another ⊓-shaped snapper, forming a reverse drive mode as mentioned above.

Figure 11:
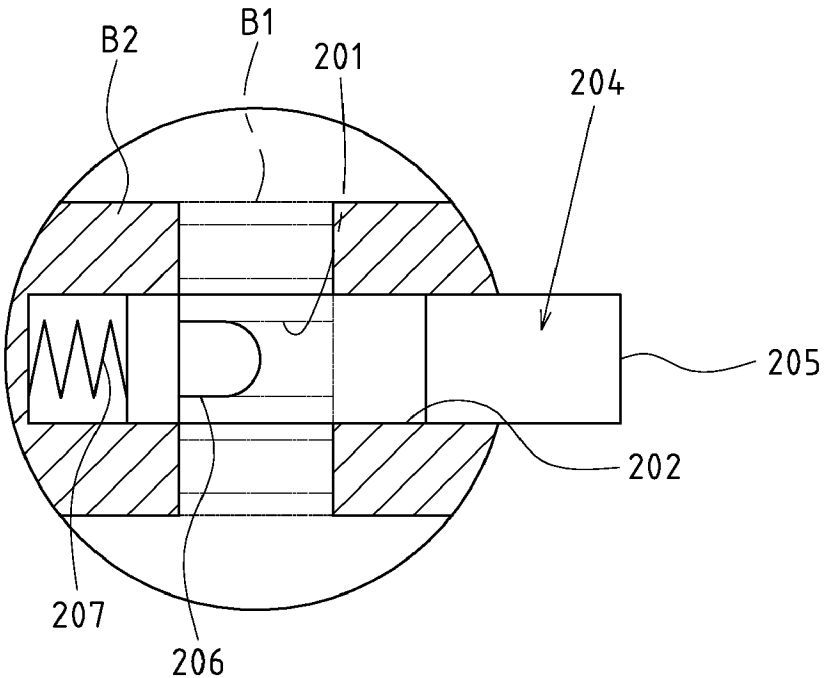
FIG. 11 shows a first isolated sectional view of the adjusting and positioning member for the flexible joint of the present invention.

The adjusting and positioning member is operated as follows:

Referring to FIG. 11 (in collaboration with FIGS. 3, 6), when the damper 204 is not pressed, it will protrude due to support pushing of the flexible resetter 207. In such case, the snap edge 206 is rightly aligned with through-hole 203 and mated with the ratchet 201. So, B1 and B2 of the flexible joint B cannot be folded for positioning.

Figure 12:
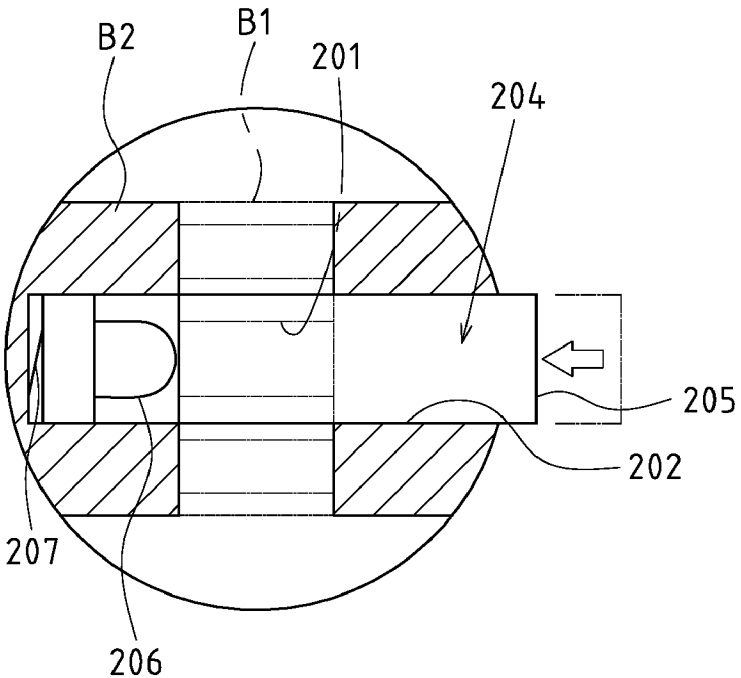
FIG. 12 shows a second isolated sectional view of the adjusting and positioning member for the flexible joint of the present invention.
Figure 13:
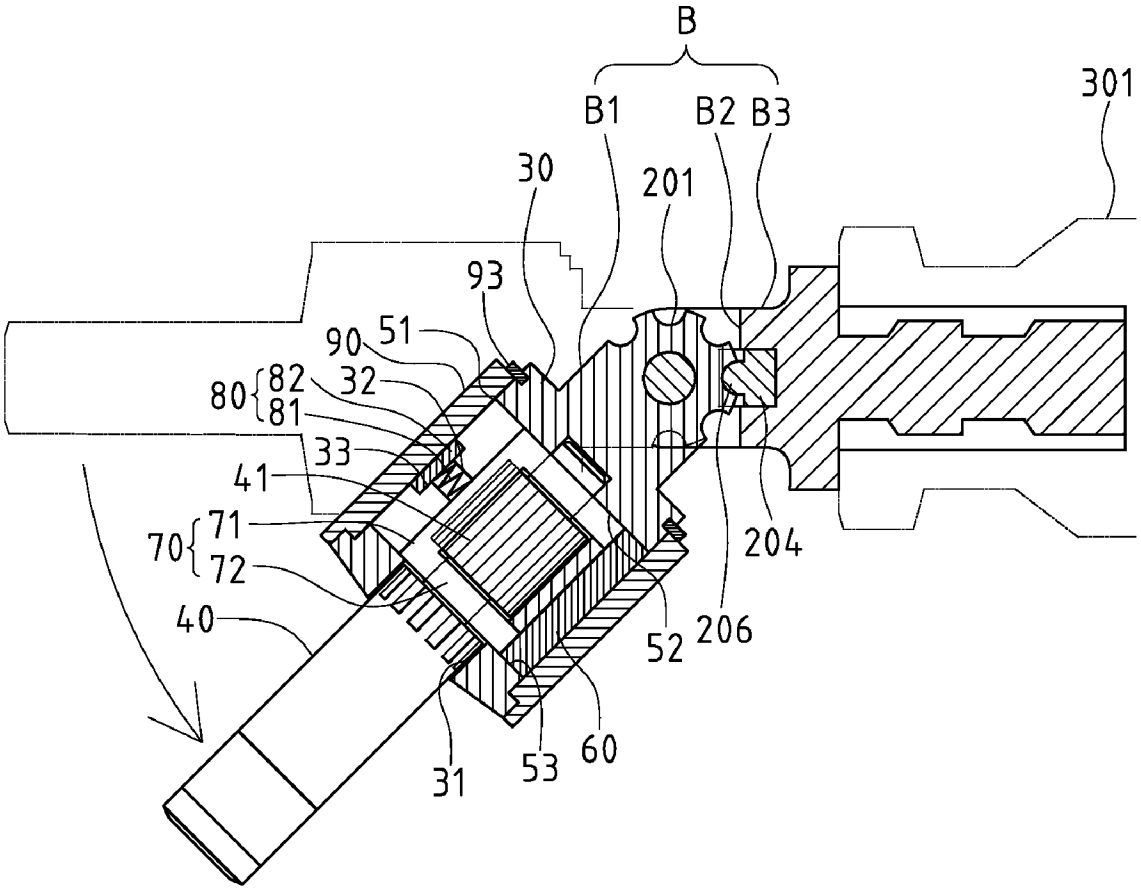
FIG. 13 shows a schematic view of foldable state of the flexible joint of the present invention.

Referring also to FIG. 12 (in collaboration with FIG. 3), when the damper 204 is pressed, the snap edge 206 will shift inwards simultaneously to be separated from the ratchet 201. The flexible resetter 207 is pressed to accumulate the restoring force. So, B1 and B2 of the flexible joint B can be folded for positioning (referring also to FIG. 13).

I claim:

1. An improved rotary positioning structure for a ratchet screwdriver in which the rotary positioning structure is mounted onto a body of the ratchet screwdriver so as to control a positive drive or reverse drive or bi-directional drive or a positioning state of a shaft lever, the body having a central axle hole suitable for insertion of a gear of the shaft lever, the ratchet screwdriver having a flexible joint between the body and a handle thereof in which a foldable state is adjusted and positioned through an adjusting and positioning member, the rotary positioning structure comprising:

a pair of radial grooves penetrating radially between the body and the central axle hole, said pair of radial grooves being arranged in parallel, each radial groove having an upper transverse slot and a pair of vertical slots and a lower transverse slot formed at a cross portion thereof, said pair of vertical slots radially penetrating the central axle hole opposite to front and rear edges of the gear of the shaft lever;

a pair of lower rivet holders positioned separately within said lower transverse slot of said pair of radial grooves so as to slide flexibly;

a retaining block positioned at a bottom of said pair of lower rivet holders so as to protrude from the body at a set height when one of the lower rivet holder slides downwardly to a preset stop position;

a pair of U-shaped snappers each comprising a transverse rack and a pair of vertical racks, each U-shaped snapper being mounted in each radial groove, said pair of vertical racks being inserted into said pair of vertical slots, said pair of vertical racks having a bottom that stops at a top of the lower rivet holder, said transverse rack being positioned opposite to a top flange of the gear of the shaft lever;

a flexible locker mounted onto an upper part of said pair of U-shaped snappers so as to flexibly press the U-shaped snappers;

a rotatable drum mounted externally to the body, said rotatable drum being limited by a spacer, said rotatable drum having a pair of troughs in spaced relation on an inner wall thereof opposite to the lower rivet holders, said pair of troughs suitable for receiving said retaining block of the lower rivet holders;

a rotating drum adjusting and positioning member mounted onto said rotatable drum opposite to the body for positioning when said rotatable drum rotates to a desired angle, the adjusting and positioning member comprising:

a ratchet mounted on a first end of the flexible joint;

a spacing groove mounted onto another end of the flexible joint, said spacing groove having a through hole laterally positioned thereon;

a damper mounted into said spacing groove, said damper having a push portion and a snap edge, said push portion protruding from said spacing groove to a desired height, said snap edge positioned opposite to said through hole of said spacing groove; and a flexible resetter mounted in said spacing groove for flexible pushing out said damper.

2. The improved rotary positioning structure of claim 1, said retaining block having a projecting semicircular cross-portion, said pair of troughs forming a curved semicircular portion.

3. The improved rotary positioning structure of claim 1, further comprising:

a ring flange positioned at a front end of the body for fixing a position of said rotatable drum, said spacer having a C-shaped snap ring locked into a ring groove at a rear end of the body for fixing the position of said rotatable drum.

4. The improved rotary positioning structure of claim 1, said rotating drum positioning member having a flexible bead and a positive positioning edge and a reverse positioning edge and a bi-directional positioning edge, said flexible bead being mounted into a chamber at a top of the body, said positive positioning edge and said reverse positioning edge and said bi-directional positioning edge arranged in spaced relation on said inner wall of said rotatable drum opposite said flexible bead, said flexible bead suitable for locking said rotatable drum at different angles.

5. The improved rotary positioning structure of claim 1, said flexible locker having a pair of springs and a cover, a pair of chambers being arranged at a top flange of the body opposite said pair of radial grooves so as to receive said pair of springs, said cover received in a recessed portion at a top of the body.

* * * * *